US005156496A

United States Patent [19]

Vidal et al.

[11] Patent Number: 5,156,496

[45] Date of Patent: Oct. 20, 1992

[54] EARTH STRUCTURES

[75] Inventors: Henri Vidal, Neuilly-sur-Seine, France; David J. Willetts; Rodney J.H. Smith, both of Telford, England

[73] Assignee: Societe Civile des Brevets de Henri Vidal, Puteaux Cedex, France

[21] Appl. No.: 652,394

[22] Filed: Feb. 7, 1991

Related U.S. Application Data

[63] Continuation of Ser. No. 274,841, Nov. 22, 1988, abandoned.

[30] Foreign Application Priority Data

Nov. 23, 1987 [GB] United Kingdom ..... 8727420

[51] Int. Cl.[5] ..... E02D 5/00

[52] U.S. Cl. ..... 405/262; 405/258; 405/284

[58] Field of Search ..... 405/258, 262, 284, 285, 405/286, 273

[56] References Cited

U.S. PATENT DOCUMENTS

| | | | |
|---|---|---|---|
| 3,316,721 | 5/1967 | Heilig | 405/262 |
| 3,570,253 | 3/1971 | Vidal | 405/284 |
| 4,117,686 | 10/1978 | Hilfiker | 405/284 |
| 4,154,554 | 5/1979 | Hilfiker | 405/273 |
| 4,266,890 | 5/1981 | Hilfiker | 405/262 X |
| 4,329,089 | 5/1982 | Hilfiker et al. | 405/262 |
| 4,341,491 | 7/1982 | Neumann | 405/258 |
| 4,505,621 | 3/1985 | Hilfiker et al. | 405/258 X |
| 4,661,023 | 4/1987 | Hilfiker | 405/262 |

FOREIGN PATENT DOCUMENTS

| | | | |
|---|---|---|---|
| 197000 | 8/1986 | European Pat. Off. . | |
| 2626650 | 12/1977 | Fed. Rep. of Germany | 405/258 |
| 8326632 | 10/1985 | Fed. Rep. of Germany . | |
| 2055983 | 5/1971 | France . | |
| 2233857 | 1/1975 | France . | |
| 2303121 | 1/1976 | France . | |
| 2546558 | 11/1984 | France . | |
| 845863 | 8/1960 | United Kingdom . | |
| 2073281 | 10/1981 | United Kingdom . | |
| 2131063 | 6/1984 | United Kingdom . | |

*Primary Examiner*—Dennis L. Taylor

*Attorney, Agent, or Firm*—Burns, Doane, Swecker & Mathis

[57] ABSTRACT

An earth structure has a facing formed of a plurality of laterally spaced support members. The top and bottom of each support member is connected to a stabilizing element that extends rearwardly into an earth mass. A mesh cover extends between adjacent support members. The support members include a front portion and integral lower and upper extensions that define a C-shaped strap. The mesh cover is also somewhat C-shaped as defined by a front portion and integral upper and lower rear projections which stiffen the cover against forward movement under earth pressure.

16 Claims, 3 Drawing Sheets

EARTH STRUCTURES

This application is a continuation of application Ser. No. 274,841, filed Nov. 22, 1988, now abandoned.

FIELD OF THE INVENTION

The invention is concerned with improvements in or relating to earth structures of the kind frictionally stabilised by a plurality of elongate stabilising elements extending rearwardly from a facing of the structure into an earth mass.

BACKGROUND OF THE INVENTION

In such structures the earth is stabilised throughout the mass by frictional engagement with the stabilising elements which are usually in the form of strips. This interaction enables the earth mass to behave as an elastic material with greatly improved resistance to failure. The facing of such a stabilised earth structures can be relatively light and has hitherto largely been built up from either V-shaped channel members of 3 mm steel or relatively thin concrete panels which are connected to the forward ends of the stabilising strips. However, even such relatively light panels represent a major element of the cost of the structure and there is a need for stabilised earth structures having a less costly facing.

It has been proposed to retain the earth at the facing of a structure stabilised by layers of embedded mesh by continuing the mesh cover the facing. Thus each element of the mesh which extends rearwardly to stabilise the earth has a corresponding continuation forming part of the facing, which may lead to a rather more substantial facing than required by the earth pressures. Furthermore the stabilising elements of the mesh embedded in the soil tend to separate the mass into layers, giving rise to less uniform stabilisation of the earth than when using strip stabilising elements.

According to one aspect of the invention there is provided an earth structure having a plurality of elongate stabilising elements extending rearwardly from a facing of the structure into an earth mass, the facing comprising at least two laterally spaced support members each connected to a pair of said stabilising elements at lower and upper points of the member, and a mesh cover spanning the lateral space between the support members, the mesh cover having a front portion supported by the support members against forward movement under earth pressure, and at least one substantially horizontal rearwardly projecting portion for stiffening the cover against such forward movement.

The invention also provides a facing panel for such a structure, comprising at least two laterally spaced support members each having means for securing said lower and upper point of the member to said stabilising elements, and a mesh cover spanning the lateral space between the support members, the mesh cover having a front portion supported in use by the support members against forward movement under earth pressure, and at least one substantially horizontal rearwardly projecting portion for stiffening the cover against such forward movement.

The invention also provides a facing for an earth structure, the facing comprising an array of facing panels according to the invention assembled to provide a continuous facing.

With such an arrangement, the support members are located and supported by the elongate stabilising elements embedded in the earth, and the separately provided grid cover may be of relatively lightweight construction designed to accommodate the earth pressures at the facing. Thus the structure may be relatively inexpensive and is particularly useful when the structure is to be temporary or of low height e.g. 3 to 6 meters.

The support members are preferably generally C-shaped, each member having a front part at the facing of the structure and a pair of lower and upper rearward extensions interconnected by the front part. The rearward extensions of the support members will normally each be relatively short and connected to a respective stabilising element and for this purpose each extension may be formed with a vertical hole for receiving a connecting bolt. Thus it is particularly advantageous if each support member is formed as a strap or belt in which a suitable hole may be provided. The support members will thus be located at intervals across the structure corresponding to the lateral spacing of the stabilising elements; such intervals normally range from 0.5 to 2 m although for very high structures, the intervals may be less than 0.5 m. The length (height) of the support members will normally vary from 0.3 to 1 m. The support members may be formed of mild steel or half mild steel or equivalent and may optionally be galvanised.

The facing of the structure may be vertical or it may be at an angle to the vertical e.g. a slope of 4:1, 2:1 or 1:1 (vertical:horizontal). The stabilising elements will generally extend substantially horizontally in the earth mass, and therefore the rearward extensions of the support members will also be substantially horizontal, even if the facing is not vertical.

Preferably the mesh cover is also generally C-shaped and thus has relatively short lower and upper rearwardly projecting portions interconnected by and integral with a substantially flat front portion. The provision of two rear projections contributes to further stiffening of the cover against forward movement. In general, it is preferred that the cover comprises a mesh facing bent rearwards along its upper and lower edges to provide tow mesh stiffening projections. Thus the shape of the mesh cover will tend to correspond to that of the support members which support the cover. The length of mesh cover will normally be sufficient to span two, three or more support members and will generally be at least 2 m and no greater than 10 m to facilitate transportation.

The mesh cover will normally be formed of mesh elements or bars arranged at right angles to each other and may for example be steel wire mesh of the type conventionally used to reinforce concrete. The laterally extending mesh bars, which in practice will normally be horizontal, may be spaced at intervals ranging from 5 to 30 cm and preferably from 10 cm to 20 cm. The diameter of thebars will normally range from 5 mm to 15 mm and preferably from 6 mm to 10 mm. The mesh bars extending upwardly of the facing may be spaced at intervals generally a bit less than the lateral bars, for example at intervals ranging from 5 cm to 30 cm and preferably from 5 cm to 15 cm, e.g. 10 cm. Their diameter will usually be slightly less than the lateral bars, ranging from 4 mm to 12 mm and preferably from 5 mm to 8 mm. The steel used may be mild steel or half mild steel or equivalent and may optionally be galvanised.

It is desirable, although not essential, for the mesh cover to be arranged such that its lateral bars are on its outside face and its upwardly and rearwardly extending bars are on its inner face. Thus in the preferred C-shaped from of the cover the lateral bar or bars of the upper stiffening projection are located above the rearwardly projecting bars, and the lateral bar or bars of the lower stiffening projection are located below the rearwardly projecting bars. This arrangement can be particularly advantageous in securing the mesh cover to the support members, since the mesh cover may be arranged with the lateral bars of its front portion located behind or inwardly of a respective support member and the lateral bar or bars of its stiffening projection located outwardly of the rear extension of the support member. By threading the support member into the cover in this way, the rear extensions of the support members will each tend to lie in the lateral space between adjacent rearwardly projecting bars of the mesh cover i.e. in the same plane.

A porous sheet, such as a fine mesh, geotextile or, more preferably, a geogrid, may be placed behind the mesh cover of prevent fine soil particles from escaping past the facing. Such a sheet will also permit hydroseeding (or equivalent) of the facing. If crushed rock is used as the backfill then such a sheet will probably not be necessary.

The structure facing will usually consist of a plurality of rows arranged one above the other, each row comprising support members at lateral spacings across the structure and one or more mesh covers spanning between the support members. The support members of adjacent rows are preferably connected to each other, and in a preferred embodiment the rear extension of such support members are separated by a vertical gap in which is located the forward end of a stabilising element connected, e.g. by a vertical bolt, to both rear extension. If the lateral bars of the mesh cover stiffening projections of adjacent rows are outwardly arranged as discussed above, then these bars will ensure the presence of such a vertical gap between the support member rear extensions.

The facing will normally be sufficiently flexible to accommodate settlement of the stabilised earth both during and after construction. The preferred C-shape of the support members allows them to flex, and in a particularly preferred embodiment the front part of each support member is formed with an angular bend, preferably at the median line between the top and bottom of the member, which, when there is relative vertical movement between the top and bottom of the member, causes forward bowing of the cover to take place relatively uniformly. This arrangement can thus ensure that bending occurs in one horizontal line across the structure, avoiding uneven bulging or flexing of the support members which could make the facing unsightly.

The elongate stabilising elements may be any such elements used in earth stabilisation. In a preferred embodiment, the stabilising elements are steel strips as described in United Kingdom Patent No. 1563317.

BRIEF DESCRIPTION OF THE DRAWINGS

Certain preferred embodiments of the invention will now be described by way of example and with reference to the accompanying drawings, in which.

DETAILED DESCRIPTION OF THE PREFERRED EMBODIMENTS

Figure 1:
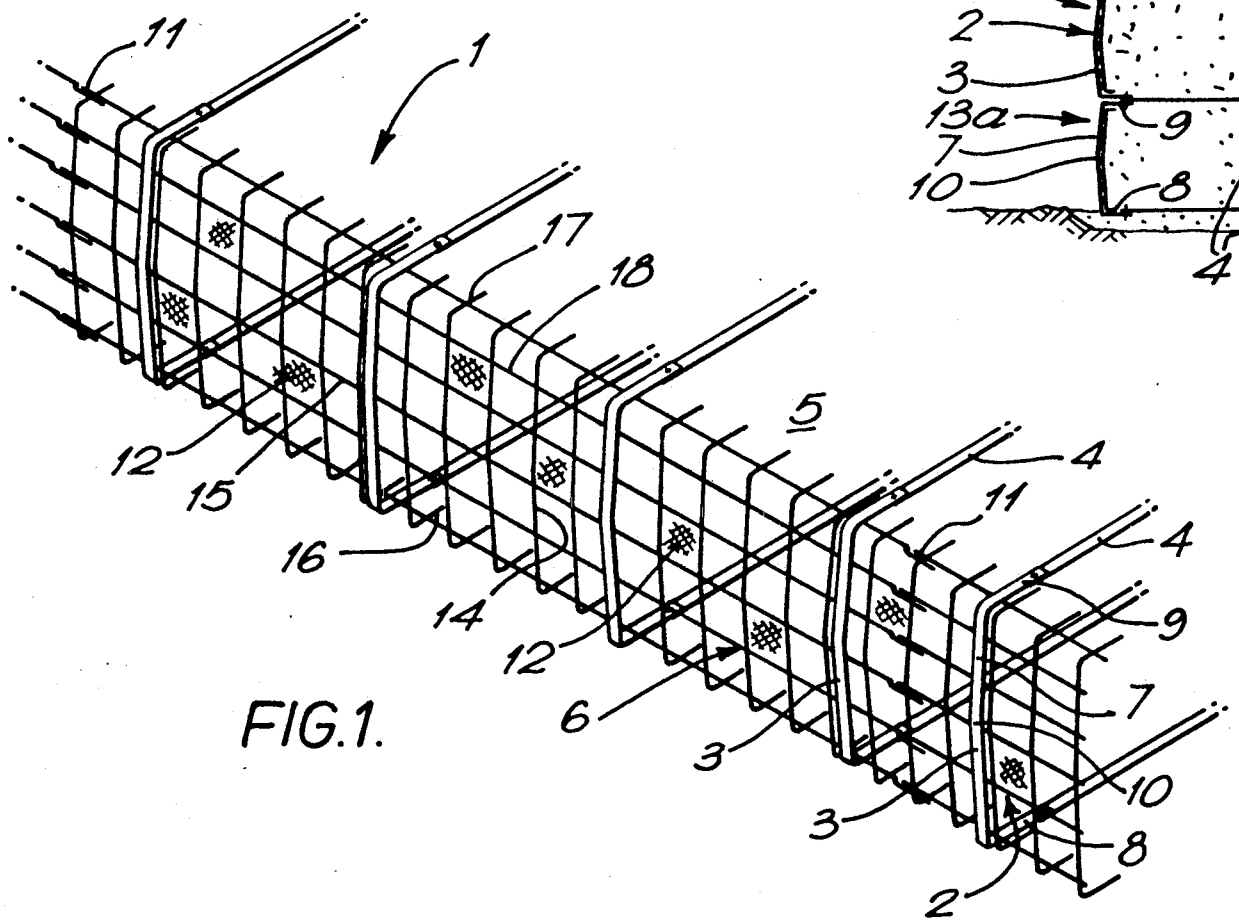
FIG. 1 is a perspective view of part of a structure according to the invention.

Referring to FIG. 1, the structure 1 has a facing 2 formed of a plurality of laterally spaced support members 3 each connected at top and bottom to a pair of elongate galvanised steel stabilising elements 4 extending rearwardly into an earth mass 5. A mesh cover 6 spans the spacing between the support members.

SUMMARY OF THE INVENTION

Each support member 3 consists of s strap having a front part 7 and integral lower and upper rear extensions 8 and 9. The straps may typically be formed of 40 mm by 5 steel strips bent to the illustrated C-shape. Each strap has an angular bend 10 midway of its front part so that the strap bows slightly forwardly. The angular bend provides a hinge to accommodate relative vertical movements of the top and bottom of the strap which may be caused by settlement of the stabilised earth backfill. If desired, however, the bend 10 can be omitted.

The mesh cover 6 fits behind the support straps 3 and in this embodiment is of sufficient length to span across four such straps. The cover has a front portion 15 formed of vertical bars 14 and lateral bars 18, the vertical bars being bent to form integral lower and upper rear projections 16 and 17. The cover is connected at each end thereof to similar covers, the connections 11 between the covers being spaced away from the adjacent support straps. The lateral spacing between the support straps on each side of this connection 11 may be reduced to compensate for the loss of stiffness caused by the connection. A geotextile filter cloth 12 fits behind the mesh cover 6 to prevent fine soil particles escaping from the facing.

Figure 2:
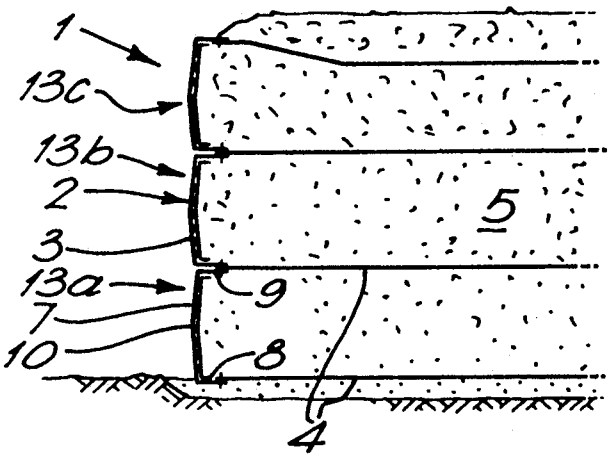
FIG. 2 is a section through the structure.

FIG. 2 shows three rows 13*a*, 13*b* and 13*c* of support straps 3 one on top of the other.

Figure 3:
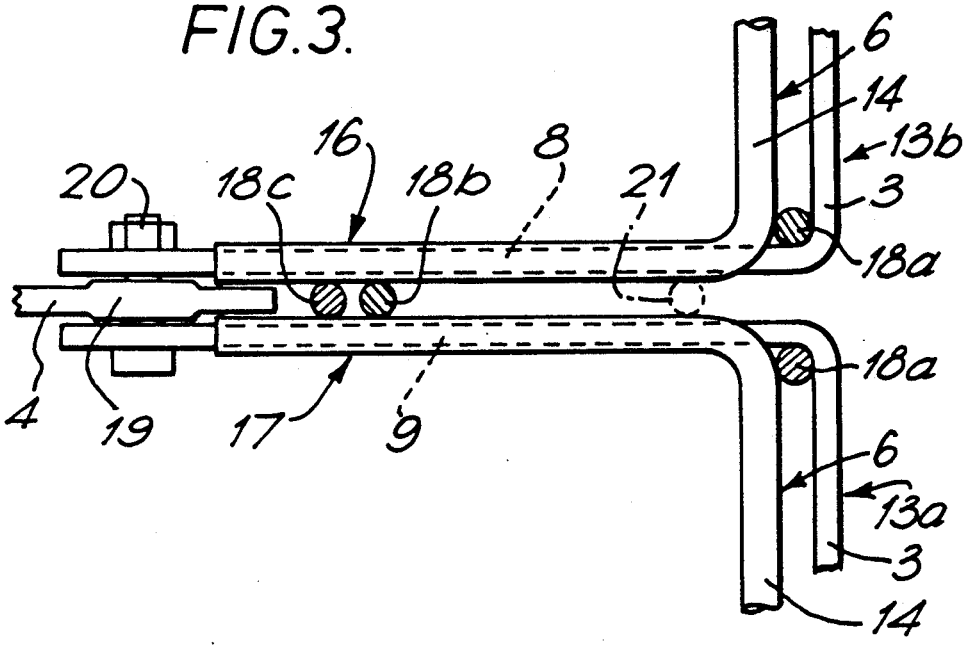
FIG. 3 is a view of the connection between adjacent rows of the structure.

FIG. 3 shows a connection 14 between the straps 3 of adjacent rows 13*a* and 13*b*. The laterally extending bars 18 of the cover are arranged outwardly of the bars 14, the cover being bent such that one of the lateral bars 18*a* is located at the outside of the bend. Referring to the arrangement of the lower row 13*a*, the cover 6 is threaded on to its associated support strap 3 such that the lateral bar 18*a* is located inwardly of the strap, while the lateral bar 18*b* of the rear projection 17 is located outwardly of the strap. Thus the upper rear extension 9 of the strap lies in the same horizontal plane as the upper rear projection 17 of the mesh cover. The lateral bar 18*b* ensures a vertical gap between the straps of the adjacent rows 13*a* and 13*b*, and a stabilising element 4 is located in this gap and bolted to both straps. The stabilising element is in the form of a steel strip having an integral thickened portion 19 through which a bolt 20 passes.

The connection between the mesh cover 6 and the support strap 3 in the upper row 13*b* is a mirror image of the row 13*a* connection, except that the lateral bar 18*c* of the lower rear projection 16 of the upper row is displaced slightly to the rear so as to nest with the bar 18*b* of the upper rear projection 17 of the lower row. An additional horizontal bar 21 may be located between the upper and lower rows to maintaining the gap near the front of the facing and assist construction.

Figure 4:
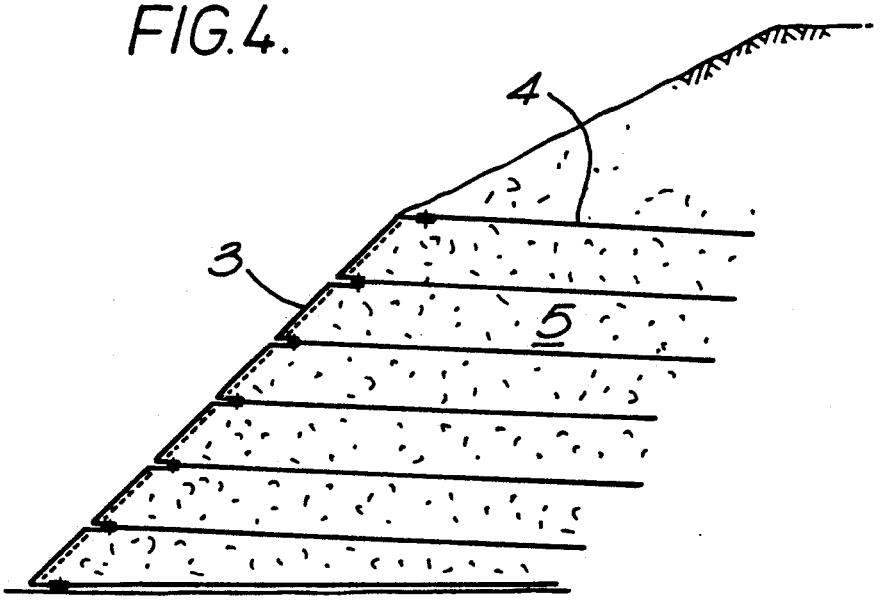
FIG. 4 is a sectional view of a second embodiment of structure according to the invention.

FIG. 4 shows another structure in which the facing has a 1:1 slope rather than being vertical.

Figure 5:
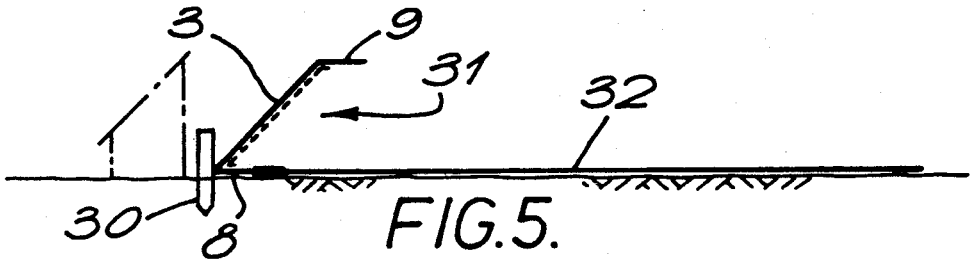
FIG. 5 to 8 are sectional views showing stages in the construction of an embodiment similar to that of FIG. 4.

The construction sequence will now be described with reference to FIGS. 5 to 8. Once the foundation has been prepare pegs or bars 30 are driven into the ground to provide alignment and support for a first course 31 of support straps 3 which are then placed in position together with the mesh covers 6. A first row 32 of stabilising elements is bolted to the lower rear extensions 8 of the support straps, as shown in FIG. 5.

Figure 6:
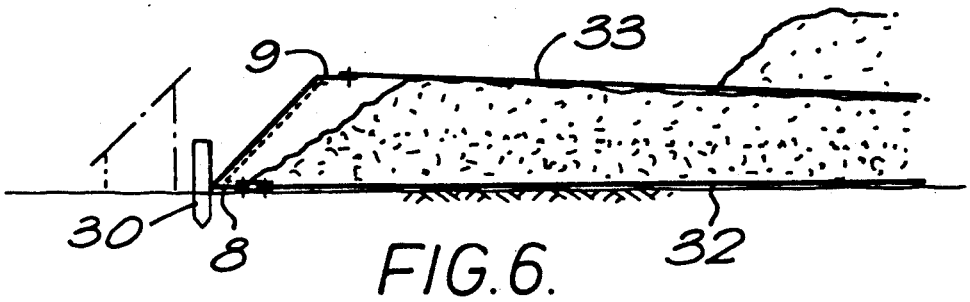

Referring to FIG. 6, backfill is placed and compacted on the row 32 of stabilising elements up to the level of the second row 33 of elements. These elements are placed at a 5% slope and loosely bolted (finger tight) to the upper rear extensions 9 of the first course 31 of support straps. The elements are used to adjust the alignment of the support straps as necessary, and are then secured by placing on their rear portions a sufficient amount of backfill to maintain the alignment as previously adjusted (see FIG. 6). The second row 33 of stabilising elements may then be disconnected from the support straps to allow a second course 34 of support straps to be installed, whereafter the row 33 of stabilising elements is reconnected by bolting through the rear extensions of both the first and second courses of straps.

Figure 7:
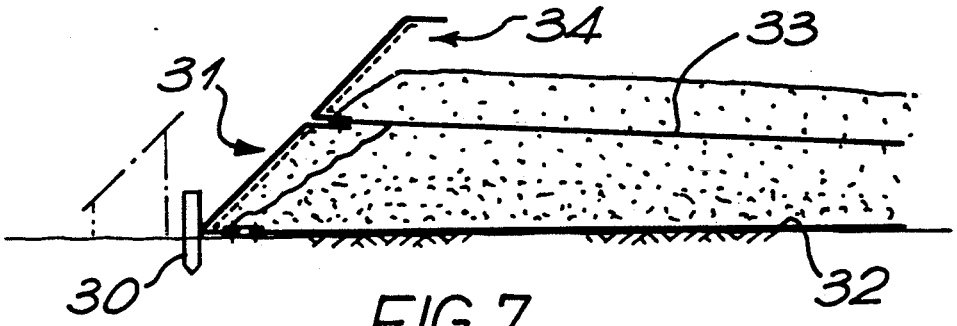

The facing is then backfilled to the extent shown in FIG. 7 i.e. right up to the first course 31. The earth is hand tamped int his front region to ensure compaction.

Figure 8:
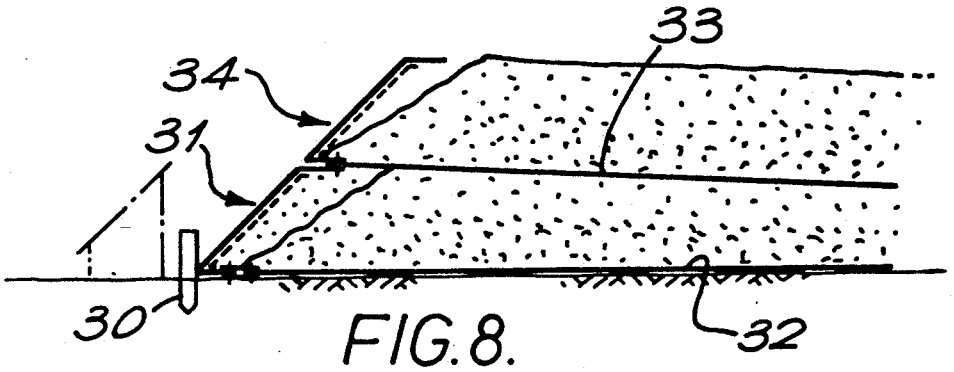

Backfilling is continued up to the level of the next row of stabilising elements as shown in FIG. 8 and the procedure for installing these is the same as for the previous row. This construction sequence is repeated for subsequent course of straps together with their mesh covers until the structure is completed.

While this invention has been illustrated and describe in accordance with a preferred embodiment, it is recognized that variations and changes may be made and equivalents employed herein without departing from the invention as set forth in the claims.

We claim:

1. An earth structure having means extending rearwardly from a facing of the structure into an earth mass to stabilize the earth mass by frictional engagement, said means including a plurality of elongate stabilizing elements extending from the facing, the facing comprising at least two laterally spaced support members each having a front part formed with a lower edge and each having a substantially horizontal lower rearward extension extending rearwardly from said lower edge, said laterally spaced support members defining a lateral space therebetween and each support member being connected to a pair of said stabilizing elements so that one of the stabilizing elements is connected to said lower rearward extension and the other stabilizing element is connected to an upper point of the support member, and a mesh cover spanning the lateral space between the support members, the mesh cover having a front portion supported by the support members against forward movement under earth pressure, and said mesh cover having at least one substantially horizontal rearwardly projecting portion for stiffening the cover against such forward movement, the front portion of the mesh cover being formed with a lower edge and wherein said substantially horizontal rearwardly projecting portion of the mesh cover projects rearwardly from said lower edge of the mesh cover's front portion.

2. An earth structure as claimed in claim 1, wherein each support member is formed with an upper edge and each of said support members includes a substantially horizontal upper rearward extensions extending rearwardly from said upper edge whereby the upper and lower rearward extension of each support member are connected by the front part of the respective support member, said upper rearward extension being provided with an upper securing means for securing a stabilizing element thereto, the mesh cover having relatively short upper and a lower rearwardly projecting portions connected to and integral with the mesh cover's front portion, the mesh cover's front portion being formed with an upper edge and said upper rearwardly projecting portion projecting rearwardly from said upper edge of the mesh cover's front portion, said lower rearwardly projecting portion being connected to a lower point of said mesh cover's front portion.

3. An earth structure as claimed in claim 1, wherein the lateral space between the support member is equal to or less than two meters.

4. The earth structure according to claim 1, wherein the substantially horizontal rearwardly projecting portion of the mesh cover is substantially perpendicular to the front portion of the mesh cover.

5. The earth structure according to claim 1, wherein said plurality of stabilizing elements each have free end positioned distal from said support member, said plurality of stabilizing elements being constructed such that the portion of each said stabilizing element adjacent the free end thereof is in contact with the earth mass to thereby aid in frictional stabilization.

6. A facing panel for an earth structure having means extending rearwardly therefrom into an earth mass for stabilizing the earth mass by frictional engagement, said means including a plurality of elongate stabilizing elements extending from the facing panel, the facing panel comprising at least two lateral spaced support members each having a front part arranged to be at the facing of the structure and formed with a lower edge, the spaced apart support members defining a lateral space therebetween and each support member having a substantially horizontally arranged lower rearward extension extending rearwardly from said lower edge of the front part, the lower rearward extension of each support members being provided with means for securing the respective support member to a respective stabilizing element, and an upper point of each support member being provided with means for securing a respective stabilizing element to the respective support member, the facing panel further comprising a mesh cover spanning the lateral space between the at least two support members, the mesh cover having a front portion supported in use by the support members against forward movement under earth pressure, and said mash cover having at least one substantially horizontally arranged rearwardly projecting portion for stiffening the cover against such forward movement, the front portion of the mesh cover being formed with a lower edge and herein said substantially horizontal projection portion of the mesh cover projects rearwardly from said lower edge of the mesh cover's front portion.

7. A facing panel as claimed in claim 6, wherein each support member has a pair of rearward extensions interconnected by the support member's front part, said pair of rearward extension including lower and upper rearward extensions, said support member's front part being formed with an upper edge and said upper rearward extension being substantially horizontally arranged and extending rearwardly from said upper edge of the support member's front part, said upper rearward extensions being provided with securing means for securing a stabilizing element thereto, and wherein the mesh cover has a pair of relatively short rearwardly projecting portions connected to and integral with the mesh cover's front portion, said rearwardly projecting portions including lower and upper rearwardly projecting portions, the mesh cover's front portion being formed with an upper edge and said upper rearwardly projecting portion projecting rearwardly from said upper edge of the mesh cover's front portion.

8. A facing panel as claimed in claim 7, wherein the mesh cover is formed with laterally extending bars and upwardly and rearwardly extending bas, said upwardly and rearwardly extending bars being positioned rearwardly of said laterally extending bars, and wherein the mesh cover is arranged with respect to the support members such that the lateral bars of the mesh cover's front portion are located inwardly of the front part of a respective support member so that the front part of the support member overlies the lateral bars of the mesh cover's front portion and such that the lateral bars of the mesh cover's rearwardly projecting portions are located outwardly of the rearward extension of the support member so that the lateral bars of the mesh cover's rearwardly projecting portions overlie the rearward extension of the support member.

9. A facing panel as claimed in claim 6, wherein the front part of each support member is formed with an angular bend.

10. A facing panel as claimed in claim 6, wherein the front part of each support member is substantially flat and the front portion of the mesh cover is substantially flat.

11. A facing for an earth structure, the facing comprising an array of facing panels as claimed in claim 6 and assembled to provide a continuous facing.

12. A facing for an earth structure, the facing comprising a plurality of rows of facing panels as claimed in claim 7 arranged one above the other, each row comprising said support members at lateral spacings across the structure and at least one of said mesh covers spanning between the support members, adjacent rearward extensions of vertically adjacent support members being separated by a vertical gap for receiving a forward end of one of said stabilizing elements, said stabilizing element being connected to both of the adjacent rearward extensions of vertically adjacent support members.

13. A facing panel for an earth structure having means extending therefrom into an earth mass to stabilize the earth mass by frictional engagement, said means including a plurality of elongate stabilizing elements extending rearwardly from the facing panel, the facing panel comprising at least two laterally spaced support members defining a lateral space therebetween, each support member having a front part arranged to be at the facing of the structure and formed with lower and upper edges, and each support member having a substantially horizontally disposed lower rearward extension extending rearwardly from said lower edge of the front part and a substantially horizontally disposed upper rearward extension extending rearwardly from said upper edge of the front part, said lower and upper rearward extensions being provided with respective securing means for securing stabilizing elements thereto, and a mesh cover spanning the lateral space between the support members, the mesh cover having a front portion supported in use by the support members against forward movement under earth pressure, said front portion being formed with lower and upper edges, said mesh cover having, for stiffening the cover against such forward movement, a relatively short lower rearwardly projecting portion projecting rearwardly from said lower edge of the front portion and a relatively short upper rearwardly projecting portion projecting rearwardly from said upper edge of the front portion.

14. A facing of an earth structure having means extend from the facing of the structure into an earth mass to stabilize the earth mass by frictional engagement, such means including a plurality of elongate stabilizing elements extending rearwardly from the facing, the facing comprising a plurality of rows of facing panels arranged one above the other, the facing panels comprising at least two laterally spaced support members defining a lateral space therebetween, each support member having a front part arranged to be at the facing of the structure and formed with lower and upper edges, each support member having a substantially horizontally arranged lower rearward extension extending rearwardly from said lower edge of the front part and a substantially horizontally arranged upper rearward extension extending rearwardly from said upper edge of the front part, said lower and upper rearward extension being provided with securing means for securing respective stabilizing elements thereto, and a mesh cover spanning the lateral space between the support members, the mesh cover having a front portion supported in use by the support members against forward movement under earth pressure, said front portion of the mesh cover being formed with lower and upper edges, said mesh cover having, for stiffening the cover against such forward movement, a lower rearwardly projecting portion projecting rearwardly from said lower edge of the front portion and an upper rearwardly projecting portion projecting rearwardly from said upper edge of the front portion, each row of facing panels comprising said support members at lateral spacings across the structure and at least one of said mesh cover spanning between the support members, adjacent rearward extensions of vertically adjacent support members being separated by a vertical gap for receiving a forward end of one of said stabilizing elements, a said stabilizing element being connected to both of the adjacent rearward extensions of vertically adjacent support members.

15. The facing panel according to claim 6, wherein the substantially horizontal rearwardly projecting portion of the mesh cover is substantially perpendicular to the front portion of the mesh cover.

16. The facing panel according to claim 6, wherein said plurality of stabilizing elements each having a free end positioned distal from said support member, said plurality of stabilizing elements being constructed such that the portion of each said stabilizing element adjacent the free end thereof is in contact with the earth mass to thereby aid in frictional stabilization.

* * * * *